US007212879B2

(12) United States Patent
Hagino

(10) Patent No.: US 7,212,879 B2
(45) Date of Patent: May 1, 2007

(54) EMBROIDERING MACHINE

(75) Inventor: Seiichiro Hagino, Chiryu (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 11/217,463

(22) Filed: Sep. 2, 2005

(65) Prior Publication Data

US 2006/0060116 A1 Mar. 23, 2006

(30) Foreign Application Priority Data

Sep. 22, 2004 (JP) ..... 2004-275223

(51) Int. Cl.
*D05C 15/23* (2006.01)

(52) U.S. Cl. ..... 700/138

(58) Field of Classification Search ..... 700/136, 700/135, 137; 112/80.3, 84, 103
See application file for complete search history.

(56) References Cited

U.S. PATENT DOCUMENTS 6,889,111 B2 * 5/2005 Tomita ..... 700/138
6,925,351 B2 * 8/2005 Larson ..... 700/138
2005/0263589 A1 * 12/2005 Kikuchi ..... 235/383

FOREIGN PATENT DOCUMENTS

JP 2848870 11/1998
JP 2005160937 * 6/2005 ..... 700/136
JP 2005165951 * 6/2005 ..... 700/136

OTHER PUBLICATIONS

U.S. Appl. No. 11/214,727, Aug. 31, 2005, Hagino.
U.S. Appl. No. 11/217,463, Sep. 2, 2005, Hagino.

* cited by examiner

*Primary Examiner*—Danny Worrell
(74) *Attorney, Agent, or Firm*—Oblon, Spivak, McClelland, Maier & Neustadt, P.C.

(57) ABSTRACT

An embroidering machine includes a base, an embroidery needle moved reciprocally along a path, an embroidery frame on which a work piece to be embroidered is held, a movable frame provided indirectly or directly on the base and mounting thereon the embroidery frame, the movable frame being driven to transverses the path of the reciprocal movement of the embroidery needle, a wireless affixed to the embroidery frame, the wireless tag storing therein frame information relating to the embroidery frame which is to be selected depending on the work piece to be embroidered, and a receiving device for reading the frame information stored in the wireless tag, the receiving device being provided on the base in immovable manner.

12 Claims, 6 Drawing Sheets

EMBROIDERING MACHINE

CROSS REFERENCE TO RELATED APPLICATIONS

This application is based on and claims priority under 35 U.S.C. § 119 to Japanese Patent Application 2004-275223, filed on Sep. 22, 2004, the entire content of which is incorporated herein by reference.

FIELD OF THE INVENTION

This invention generally relates to an embroidering machine. More particularly, this invention pertains to an embroidering machine that automatically performs embroidery on the basis of embroidery data.

BACKGROUND

A known embroidering machine generally judges whether embroidery fits into an embroidery frame used in the embroidering machine by comparing data related to a shape or a size of each frame with embroidery data. In these circumstances, a related issue is the method for obtaining frame data.

A known embroidering machine is described in JP 2848870B which includes a movable frame and an embroidery frame. The movable frame is movable within a plane surface and the embroidery frame for holding cloth is detachably assemblable to the movable plate. A bar code, which is storing information indicating an embroidery frame type, is fixed to the embroidery frame, and a bar code reader is provided on the movable frame.

With the structure of the known embroidering machine, various embroidery frames can be used in response to an item or, a part to be embroidered. Frames having different shapes such as a flat frame and a cap frame are attached to movable frames having different shapes. Accordingly, when the bar code reader is provided on the movable frame, the bar code reader should be provided on each one of various movable frames respectively. In such circumstances, the question of cost is invariably arises. Further, a contacting portion for transmitting a signal should respectively be provided on the movable frame and the embroidering machine body.

A need thus exists for an embroidering machine configured to obtain information related to the embroidery frame at a low cost and to simplify a path that transmits the information.

SUMMARY OF THE INVENTION

According to the present invention, an embroidering machine includes a base, an embroidery needle moved reciprocally along a path, an embroidery frame on which a work piece to be embroidered is held, and a movable frame provided indirectly or directly on the base and mounting thereon the embroidery frame, the movable frame being driven to transverse the path of the reciprocal movement of the embroidery needle. The embroidering machine further includes a wireless tag affixed to the embroidery frame, the wireless tage being storing therein frame information relating to the embroidery frame which is to be selected depending on the work piece to be embroidered and a receiving means for reading the frame information stored in the wireless tag, the receiving means being provided on the base in immovable manner.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

According to embodiments of the present invention, receiving means is provided on leg portions disposed to face each other on the sides of a base, and/or a throat plate having a needle-piercing hole into which an embroidery needle is inserted.

According to the embodiments of the present invention, if an embroidery frame is in the form of a cap frame or a cylindrical frame, the receiving means provided on the throat plate reads frame information, and, if the embroidery frame is in the form of a flat frame, the receiving means provided on the leg portion reads the frame information.

According to the embodiments of the present invention, the frame information stored in a wireless tag is an ID, (i.e., code), of the embroidery frame. By using the ID, (i.e., code), as a key, the embroidering machine identifies a shape or a size of the embroidery frame with reference to a detailed information database related to the embroidery frame. The embroidering machine receives the frame information corresponding to the ID by providing the wireless tag on the embroidery frame, and by reading the ID with reference to a frame information database. On this occasion, the frame information database may be provided either in the embroidering machine, or in an external device such as a memorizing device connected to plural embroidering machines through networks, and can be accessed with a server device which transmits embroidery data to the plural embroidering machines.

A first embodiment of the present invention is explained with reference to the attached drawings.

Figure 1:
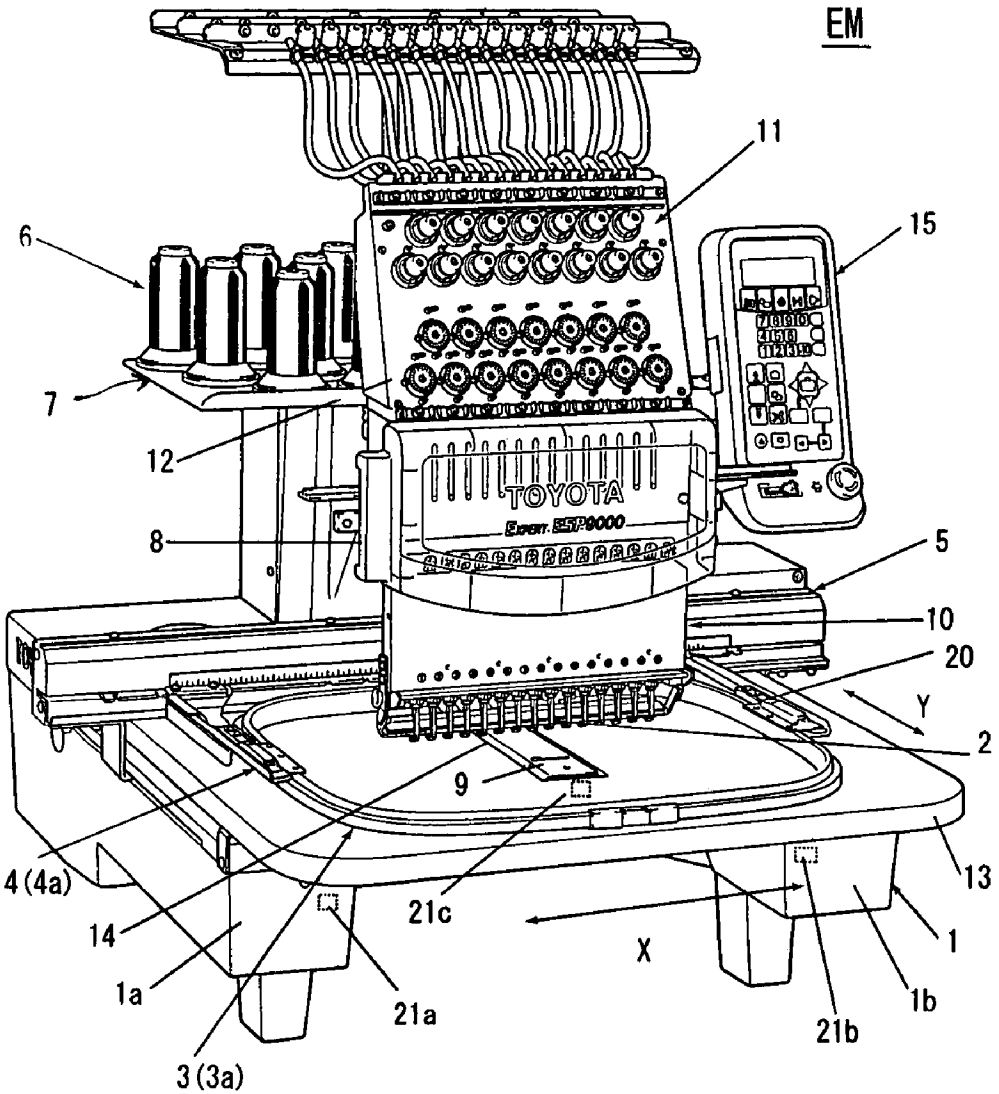
FIG. 1 illustrates an overall structure of an embroidering machine according to a first embodiment of the present invention.

With reference to FIG. 1, an embroidering machine EM includes a base 1, plural embroidery needles 2 each of which moves reciprocally along a vertical path, an embroidery frame 3 on which a work piece to be embroidered is held, a movable frame 4 which is assembled on the base 1 in movable fashion so as to be driven to traverse the path of the reciprocal movement of each of the embroidery needles 2. The embroidery frame 3 is attached to the movable frame 4.

The embroidering machine EM further includes a known frame operating mechanism 5 which is, for example, in the form of a layered structure of X direction operating mechanism and Y direction operating mechanism, a bobbin holder 7, a needle selecting mechanism 8 which is disclosed in, for example, in JP53(1978)-43336B or JP55(1980)-8626B, a known sewing mechanism 10, and a throat plate 14. The frame operating mechanism 5 allows the frame 4 to move in X and/or Y directions in a horizontal plane on an embroidery board 13 mounted on the base 1. The bobbin holder 7 is normally provided with plural bobbins 6. The needle selecting mechanism 8 selects one of the plural needles 2 and place the resulting or selected needle 2 at a position just above a needle-piercing hole 9 of a throat plate 14. The sewing mechanism 10 drives the selected needle 2 to reciprocate vertically to make embroideries on the work piece. During the reciprocal movement of the needle 2, the needle passes through the needle-piercing hole 9 of the throat plate 14.

The embroidery frame 3 is applied or adhered thereon with a wireless tag 20 storing embroidery frame information.

Antennas 21*a* and 21*b* for receiving the embroidery frame information stored in the wireless tag 20 are provided on leg portions 1*a* and 1*b*, respectively, which are disposed to face each other on the sides of the base 1. An antenna 21*c* for receiving the embroidery frame information stored in the wireless tag 20 is also provided on the throat plate 14. Two types of the three receiving means 21*a*, 21*b*, and 21*c* are provided at such predetermined positions make it possible to read the information of the wireless tag 20 affixed to the embroidery frame 3, regardless of a shape or a size of the embroidery frame 3. Preferably, each of the receiving means 21*a*, 21*b*, and 21*c* transmits a predetermined radio or electromagnetic wave to recognize or read the ID of the embroidery frame 3 of wireless tag 20.

With the structure of the embroidering machine EM, each of threads wound around respective spools 6 is routed to the corresponding needle 2 by way of a tension 11, a hole of a thread guiding plate 12, and a hole of a thread take up lever. The needle selecting mechanism 8 selects and moves one of the plural needles 2 to a position just above the needle-piercing hole 9 of the throat plate 14. Then, the sewing mechanism 10 brings the selected needle 2 into vertical movement in reciprocal mode to make one or more pieces of embroidery on the work piece s is well known.

Figure 2:
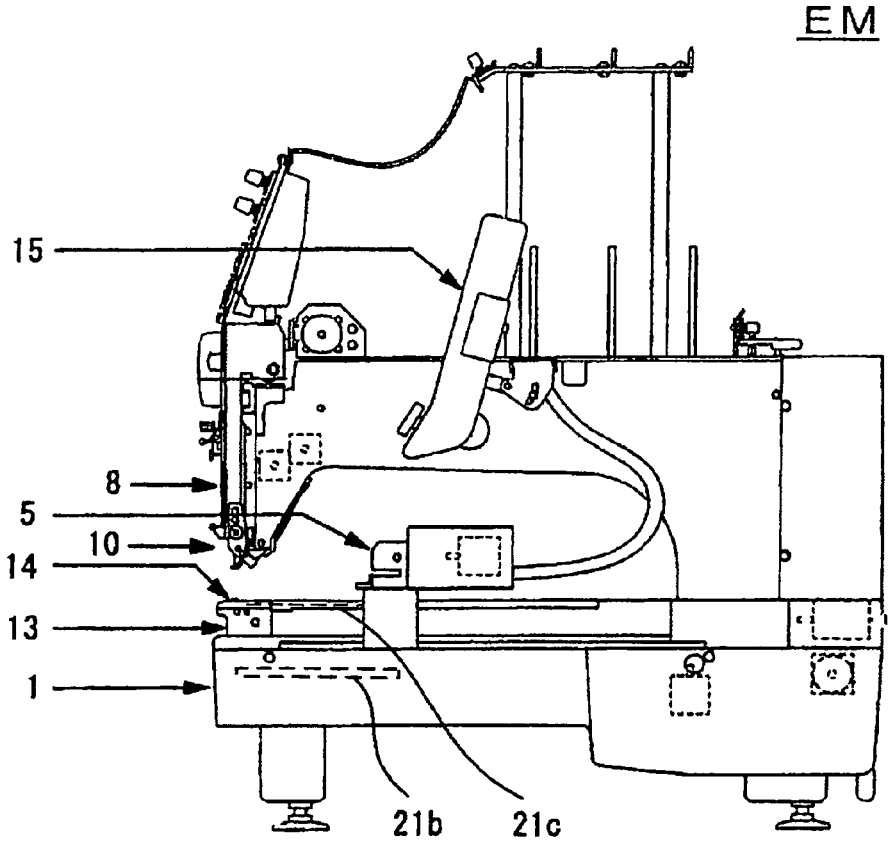
FIG. 2 illustrates a side view of the embroidering machine illustrated in FIG. 1.

With reference to FIG. 2, the embroidering machine EM further includes a controller 15 which controls, on the basis of the embroidery data transmitted from a server device PC through a network, the frame operating mechanism 5, the needle selecting mechanism 8, and the sewing mechanism 10.

Figure 3:
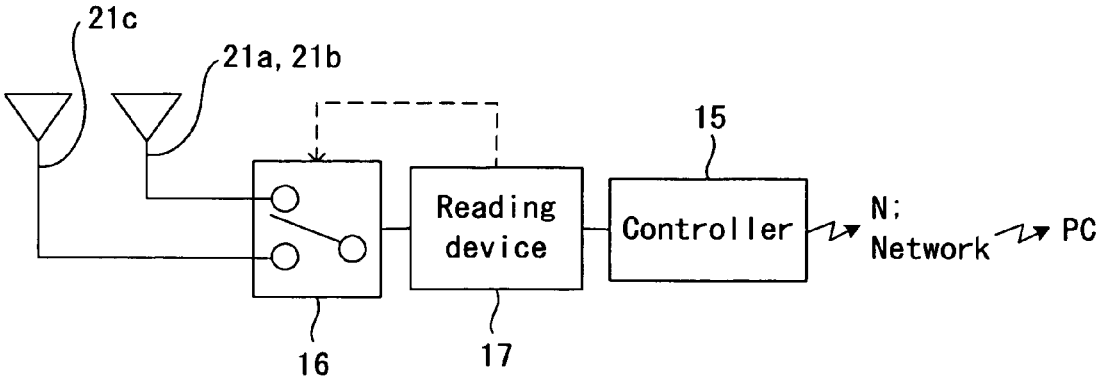
FIG. 3 illustrates schematically how embroidery frame information is obtained in the embroidering machine illustrated in FIG. 1.

With reference to FIG. 3, there is schematically illustrated how the embroidery frame information is fed to the embroidering machine EM. A series set of switch 16 and reading means 17 is interposed between the controller 15 and each of the antennas 21*a* and 21*b* and the antenna 21*c*. By bringing the switch 16 into one position (the other position), the embroidery frame information received by the antennas 21*a* and 21*b* (the antenna 21*c*) is transmitted to the controller 15 or in some cases to the server device PC through the controller 15.

Table 1 is an example of an embroidery frame information database.

TABLE 1

| Code | centx | centy | lenx | leny | Hoop Type | Description |
|---|---|---|---|---|---|---|
| 1 | 0 | −426 | 750 | 750 | circular | 240 mm |
| 2 | 0 | −426 | 400 | 400 | circular | 140 mm |
| 3 | 0 | −426 | 500 | 500 | circular | 170 mm |
| 4 | 0 | −426 | 600 | 600 | circular | 200 mm |
| 5 | 0 | −426 | 820 | 820 | rectangular | 240*240 mm |
| 6 | 0 | −426 | 1220 | 620 | rectangular | 308*196 mm |
| 7 | 0 | −426 | 1220 | 820 | rectangular | 309*236 mm |
| 8 | 0 | −19 | 1720 | 870 | rectangular | 445*240 mm |
| 9 | 0 | −19 | 1720 | 1070 | rectangular | 445*290 mm |
| 10 | 0 | 126 | 2030 | 1150 | rectangular | 460*300 mm |
| 11 | 0 | 126 | 2300 | 1350 | rectangular | 460*300 mm |
| 12 | 0 | −945 | 150 | 150 | circular | 70 mm |
| 13 | 0 | −845 | 230 | 230 | circular | 90 mm |
| 14 | 0 | −695 | 330 | 330 | circular | 120 mm |
| 15 | 0 | −812 | 170 | 320 | rectangular | 70*100 mm |
| 16 | 0 | −962 | 320 | 170 | rectangular | 100*70 mm |
| 17 | 0 | −712 | 270 | 420 | rectangular | 90*120 mm |
| 18 | 0 | −862 | 420 | 270 | rectangular | 120*90 mm |
| 19 | 0 | −552 | 400 | 550 | rectangular | 120*150 mm |
| 20 | 0 | −702 | 550 | 400 | rectangular | 150*120 mm |
| 21 | 0 | −937 | 70 | 220 | circular | 49*80 mm |
| 22 | 0 | −1092 | 220 | 70 | circular | 80*49 mm |
| 23 | 0 | 31 | 100 | 50 | circular | 70 mm |
| 24 | 0 | 31 | 180 | 130 | circular | 90 mm |
| 25 | 0 | 31 | 280 | 230 | circular | 120 mm |
| 26 | 0 | 31 | 390 | 340 | circular | 150 mm |
| 27 | 0 | 31 | 220 | 680 | rectangular | 200*115 mm |
| 28 | 0 | 31 | 800 | 750 | rectangular | 240*240 mm |
| 29 | 0 | 31 | 1270 | 800 | rectangular | 240*300 m |
| 30 | 0 | 31 | 1820 | 1000 | rectangular | 320*450 mm |
| 31 | 0 | 31 | 390 | 340 | circular | 180 mm |
| 32 | 0 | 31 | 390 | 340 | circular | 210 mm |

Figure 4:
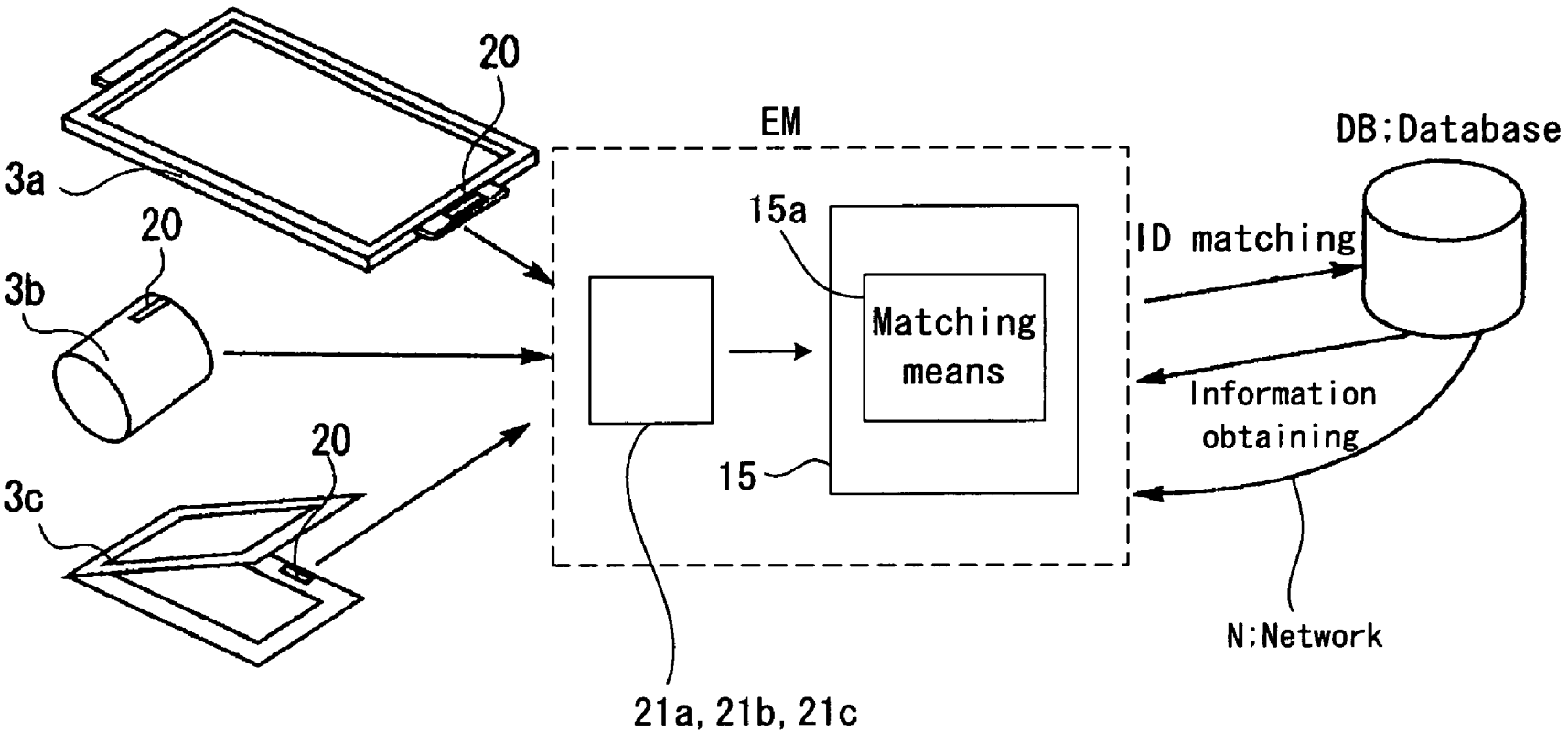
FIG. 4 is a diagram for explaining a matching system of the embroidery frame information in the embroidering machine illustrated in FIG. 1.

With reference to FIG. 4, the embroidering machine EM and an embroidery frame information database DB constitute an embroidery frame information matching system. As previously described, the embroidering machine EM is equipped with the receiving means 21*a*, 21*b*, and 21*c* for receiving the embroidery information, for example, the embroidering frame ID stored in the wireless tag 20 which is affixed to the embroidery frames 3*a*, 3*b*, and 3*c*. The embroidery information database DB can be directly or indirectly accessed with the embroidery frame information matching system through the network N. As shown in Table 1, the database DB stores detailed embroidery frame information corresponding to the embroidery frame ID (i.e., code). The controller 15 includes the matching means 15*a* for obtaining the detailed embroidery frame information by matching the database DB on the basis of the embroidery frame ID received by the receiving means 21*a*, 21*b*, and 21*c*.

With the structure of the embroidering machine according to another embodiment of the present invention, the embroidery frame information matching system may include one or more multi needle automatic thread change-type embroidering machines EM, the server device PC, the database DB, and the matching means 15*a*. The server device PC in this case is connected to one or more embroidering machine EM through the network, the database DB can be provided either inside or outside the server device PC, and the matching means 15*a* is provided in the server device PC and obtains thread information relative to the thread information database DB on the basis of the thread ID received by the receiving means 21*a*, 21*b*, and 21*c*.

Figure 5:
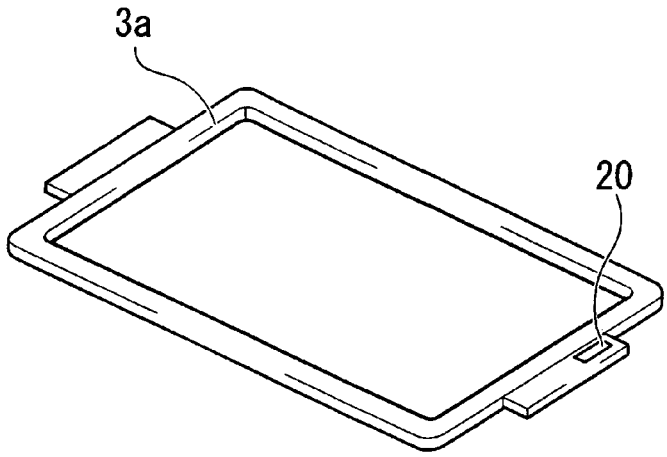
FIG. 5 shows an example of wireless tag affix position.

FIG. 5 illustrates an example of a position on which the wireless tag 20 is affixed. Referring to FIGS. 1 and 5, when the embroidery frame 3 is in the form of a flat frame 3*a*, the flat frame 3*a* is assembled, via a movable frame 4*a*, to the frame operating mechanism 5. The movable frame 4*a* includes assembling portions extended in Y direction, the flat frame 3*a* is provided with ear portions on its side portion with which the assembling portion of the movable frame 4*a* is detachably engaged, and the wireless tag 20 is affixed to at least one of the ear portions. When the flat frame 3*a* is used, the resultant shorter or even minimum receiving distance make it possible for the receiving means 21*a* and 21*b* provided on the leg portions 1*a* and 1*b* of the frame to receive the information of the wireless tag 20 successfully.

Figure 6:
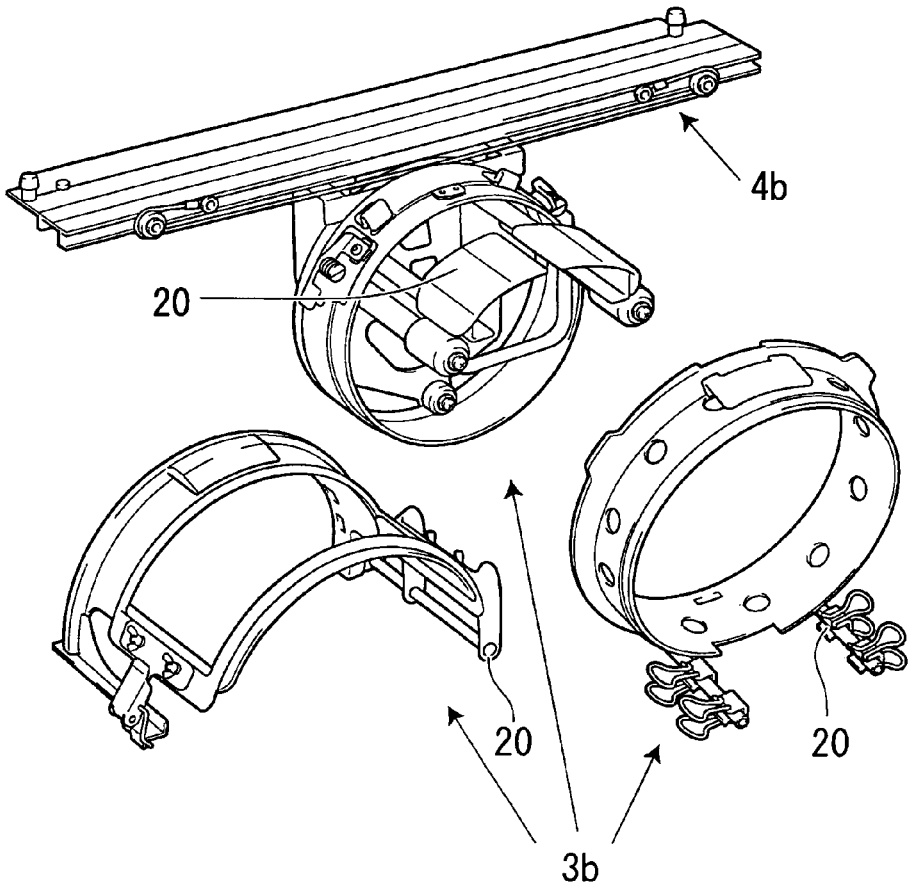
FIG. 6 shows another example of wireless tag affix position.
Figure 7:
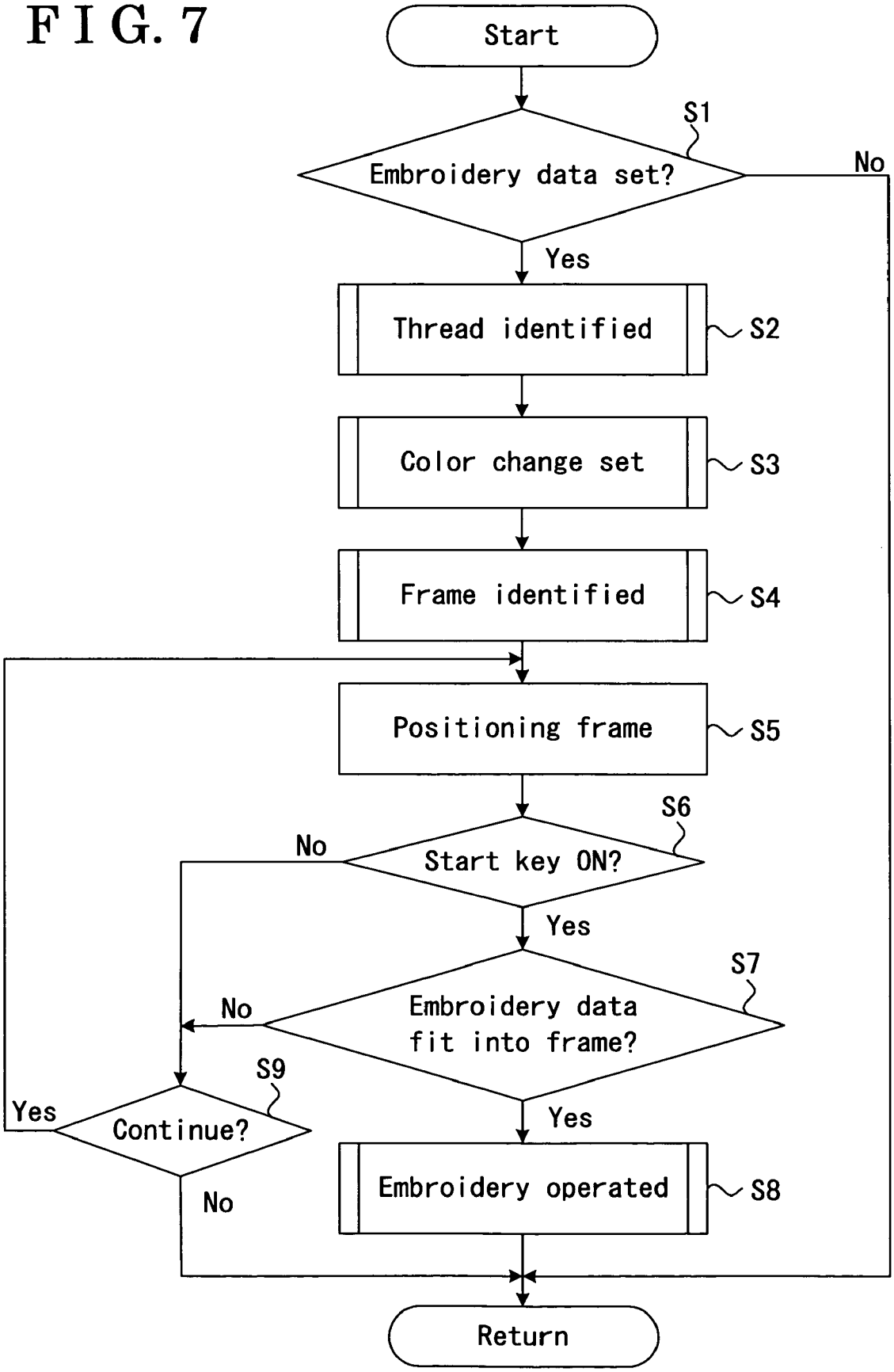
FIG. 7 is a flow chart for explaining an embroidery operation of the embroidering machine illustrated in FIG. 1 which includes obtaining the embroidery frame.

FIG. 6 illustrates another example of a position on which the wireless tag 20 is affixed. With reference to FIGS. 1 and 6, when the cap frame 3*b* is used as the embroidery frame to be assembled to the frame operating structure 5 through a movable frame 4*b*, the movable frame 4*b* for the cap frame 3*b* is shorter than the movable frame 4*a* for the flat frame 3*a* (ref. FIG. 1) in a X direction, and includes the assembling portion provided on its center portion in the X direction, and the cap frame 3*b* is provided with an engaging potion on its end portion with which the assembling portion of the movable frame 4*b* is detachably engaged. The wireless tag 20 is affixed to the cap frame 3*b* on an extending portion of the fat frame 3*b* which holds a hat and extends in a Y direction. When the cap frame 3*b* is used, the frame information of the wireless tag 20 is preferably received by the receiving means 21*c* provided on the throat plate 14 positioned on the center of the embroidery board 13 because the receiving distance is reduced.

A basic embroidery operation of the aforementioned embroidering machine EM will be explained with reference to FIGS. 1–7.

Prior to the basic embroidery operation, the plural bobbins 6 are mounted on the bobbin holder 7, the embroidery frame 3 is assembled to the frame operating mechanism 5 through the movable frame 4, and the controller 15 of the embroidering machine EM is turned on. In step S1, the embroidery data transmitted from the server device PC is read and stored in the controller 15. The controller 15 controls the needle selecting mechanism 8 on the basis of the embroidery data, which refer to as embroidery design data.

In step S2, identification of the thread is performed so as to identify, for example, a color of the thread, which is supplied to each needle 2. In step S3, if a thread color indicated by the embroidery data is not available, a color change setting is performed so as to use the thread of the approximating most to that indicated.

In step S4, identification of the embroidery frame 3 is performed.

Figure 8:
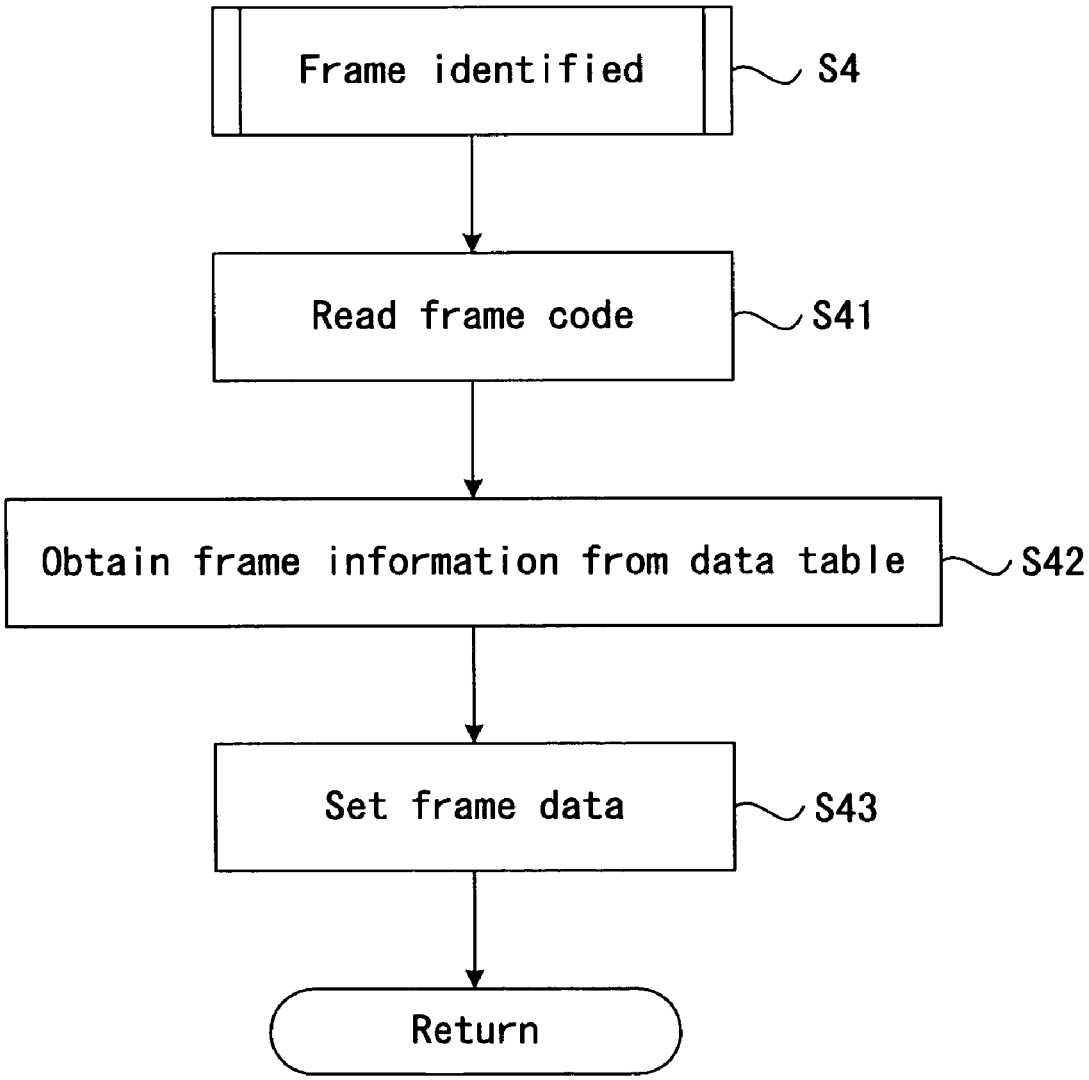
FIG. 8 is a flow chart for a detailed explanation of an identifying operation depicted in FIG. 7.

Referring particularly to FIG. 8, the embroidery frame ID (i.e., frame code) from the wireless tag 20 is received by at least one of the receiving means 21*a*, 21*b*, and 21*c* in step S41, the controller 15 obtains the detailed frame information shown in Table 1 from the database DB through the matching means 15*a* in step S42, and the frame data is set into the controller 15 in step S43.

In step S5, positioning of the embroidery frame 3 relative to the base 1 is performed and a position of the embroidery frame 3 is detected. In step S6, a judgment is made whether a start key of the controller 15 is turned on or not. If the result is true, the control goes to step S7. Otherwise, the control goes to step S9 and if its result is to continue the job the control goes to step S5.

In step S7, the controller 15 compares the position of the embroidery frame 3 with the embroidery data on the basis of obtained embroidery frame information to judge whether or not the embroidery data (i.e., an embroidery design) fits or falls into a selected embroidery frame 3. If the result is true, the control goes to step S8. Otherwise, the control goes to step S9 to display a predetermined indication or warning and thereafter goes to step S5 for re-performing the positioning of the embroidery frame 3.

The present invention can be applied to multi needle thread change-type embroidering machines, in particular, to multi needle automatic thread change-type embroidering machines and further to an embroidering machine system created by connecting such embroidering machines in parallel. The present invention can also be applied to various knitting machines or knitting machine systems which rely on an automatic change of threads.

According to the present invention, the receiving means for reading the embroidery information is provided on a stationary portion, which need not necessarily be replaced or changed corresponding to the embroidery frame. In other words, the receiving means is provided on the base (i.e., the embroidering machine body). Thus, the information related to the embroidery frame can be obtained at a low cost. Because the frame information is read by using a radio transmission, the receiving means need not necessarily be provided on the movable frame to which the embroidery frame is directly attached, but can be provided on the embroidering machine body, and the wiring for transmitting the frame information from the receiving means is thereby simplified. Moreover, it is not necessary for a user of the embroidering machine to input the embroidery frame information, and the losses caused by input errors made by a user can be prevented. By adding the frame type information to the database, the embroidering machine according to the present invention can also without difficulty be made to correspond to diversifying frame types. The receiving means which reads the embroidery information such as the embroidery frame ID can also be used for obtaining other information such as thread information, by standardizing an ID format related to, for example, the frame type, and to the thread type.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. An embroidering machine comprising:

a stationary base;

an embroidery needle moved reciprocally along a path;

an embroidery frame on which a work piece to be embroidered is held;

a movable frame provided indirectly or directly on the stationary base and mounting thereon the embroidery frame, the movable frame being driven to traverse the path of the reciprocal movement of the embroidery needle;

a wireless tag affixed to the embroidery frame, the wireless tag storing therein frame information relating to the embroidery frame which is to be selected depending on the work piece to be embroidered; and receiving means for reading the frame information stored in the wireless tag, the receiving means being provided on the stationary base.

2. The embroidering machine according to claim 1, wherein the receiving means is provided on leg portions disposed to face each other on the sides of the stationary base.

3. The embroidering machine according to claim 1, wherein the receiving means is provided on a throat plate having a needle-piercing hole through which the embroidery needle passes.

4. The embroidering machine according to claim 2, wherein the receiving means is provided on a throat plate having a needle-piercing hole through which the embroidery needle passes.

5. The embroidering machine according to claim 2, wherein the embroidery frame is in the form of a flat frame and the receiving means provided on the leg portions reads the frame information from the wireless tag on the flat frame.

6. The embroidering machine according to claim 3, wherein the embroidery frame is in the form of a cap frame or a cylindrical frame and the receiving means provided on the throat plate reads the frame information from the cap frame or the cylindrical frame.

7. The embroidering machine according to claim 1, wherein the frame information stored in the wireless tag is an embroidery frame ID code by which a detailed embroidery-frame related information database is retrieved to identify a shape or a size of the embroidery frame.

8. The embroidering machine according to claim 2, wherein the frame information stored in the wireless tag is an embroidery frame ID code by which a detailed embroidery-frame related information database is retrieved to identify a shape or a size of the embroidery frame.

9. The embroidering machine according to claim 3, wherein the frame information stored in the wireless tag is an embroidery frame ID code by which a detailed embroidery-frame related information database is retrieved to identify a shape or a size of the embroidery.

10. The embroidering machine according to claim 4, wherein the frame information stored in the wireless tag is an embroidery frame ID code by which a detailed embroidery-frame related information database is retrieved to identify a shape or a size of the embroidery.

11. The embroidering machine according to claim 5, wherein the frame information stored in the wireless tag is an embroidery frame ID code by which a detailed embroidery-frame related information database is retrieved to identify a shape or a size of the embroidery.

12. The embroidering machine according to claim 6, wherein the frame information stored in the wireless tag is an embroidery frame ID code by which a detailed embroidery-frame related information database is retrieved to identify a shape or a size of the embroidery frame.

* * * * *